US005845850A

United States Patent [19]

Guo

[11] Patent Number: 5,845,850

[45] Date of Patent: Dec. 8, 1998

[54] SPRINKLER HAVING OSCILLATORY WAVE

[76] Inventor: Wen Li Guo, No. 10, Fang Dong Road, Wen Gin Tsuen, Fang Yuan Hsiang, Chang Hua Hsien, Taiwan

[21] Appl. No.: 847,014

[22] Filed: May 1, 1997

[51] Int. Cl.[6] ..... B05B 3/16

[52] U.S. Cl. ..... 239/242; 239/265; 239/587

[58] Field of Search ..... 239/225, 227, 239/237, 240, 242, 243, 246, 247, 248, 265, 566, 587

[56] References Cited

U.S. PATENT DOCUMENTS 4,245,786 1/1981 Abrahamsen et al. ..... 239/242
4,568,023 2/1986 Hayes ..... 239/242
5,042,719 8/1991 Magris et al. ..... 239/242
5,628,458 5/1997 Kuo ..... 239/242
5,657,928 8/1997 Jian ..... 239/242

*Primary Examiner*—Andres Kashnikow
*Assistant Examiner*—Lisa Ann Douglas

[57] ABSTRACT

A sprinkler includes a tube rotatably secured in a base for receiving water. A pipe has an extension rotatably secured to the tube and has a number of annular recesses and ports. A number of sleeves are rotatably engaged in the annular recesses of the pipe and each has one or more outlets adjustable to different angular position relative to the pipe for allowing the pipe to be rotated by water flowing out through the outlets. A bar may secure the pipe to the tube for allowing the tube and the pipe to be rotated in concert with each other.

8 Claims, 4 Drawing Sheets

SPRINKLER HAVING OSCILLATORY WAVE

BACKGROUND OF THE INVENTION

1. Field of the Invention

The present invention relates to a sprinkler, and more particularly to a sprinkler having an oscillatory wave that may be adjusted.

2. Description of the Prior Art

A typical sprinkler is disclosed in U.S. Pat. No. 4,568,023 to Hayes and comprises a complicated adjusting mechanism for adjusting the spraying angle of the sprinkler.

The present invention has arisen to mitigate and/or obviate the afore-described disadvantages of the conventional sprinklers.

SUMMARY OF THE INVENTION

The primary objective of the present invention is to provide a sprinkler which includes a greatly simplified configuration for allowing the sprinkler to adjust to different oscillation conditions.

In accordance with one aspect of the invention, there is provided a sprinkler comprising a base having a tube for receiving water, the tube having a stud, a pipe including an extension rotatably secured to the stud of the tube for receiving water from the tube and for allowing the pipe to be rotated about the stud, the pipe including a plurality of annular recesses and a plurality of ports communicating with the annular recesses, and a plurality of sleeves rotatably engaged in the annular recesses of the pipe, the sleeves each including at least one first outlet communicating with the port for allowing water to flow out of the first outlet via the port. The sleeves and the first outlets of the sleeves are adapted to be rotated relative to the pipe for allowing outlet water to force the pipe to rotate about the stud.

The sleeves each includes at least one second outlet and a nozzle secured in the second outlet. The nozzle has an inclined passage for allowing the outlet water to be inclined relative to the second outlet.

The second outlet each includes at least one rib for engaging with the nozzle and each includes a cap for securing the nozzle in the second outlet.

The pipe includes at least one nozzle engaged in the first outlet.

A conduit includes a first end having a ball rotatably engaged in the stud and includes a second end, a gasket is engaged between the ball and the stud, a cover is secured to the stud for rotatably retaining the ball in the stud, the extension of the pipe is rotatably engaged in the second end of the conduit.

In accordance with another aspect of the invention, there is provided a sprinkler comprising a tube rotatably secured in a base for receiving water and including a stud and at least one projection, a pipe including an extension rotatably secured to the stud of the tube for receiving water from the tube and for allowing the pipe to be rotated about the stud, the pipe including at least one pin, and at least one bar including a first end engaged with the projection of the tube and including a second end for engaging with the pin and for securing the pipe to the tube and for allowing the tube and the pipe to be rotated in concert with each other about the tube.

The bar has a number of apertures for engaging with the projection and for allowing the pipe to be adjusted to different inclined angle relative to the tube. The second end of the bar includes a hook for engaging with the pin and for allowing the hook to be disengaged from the pin.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
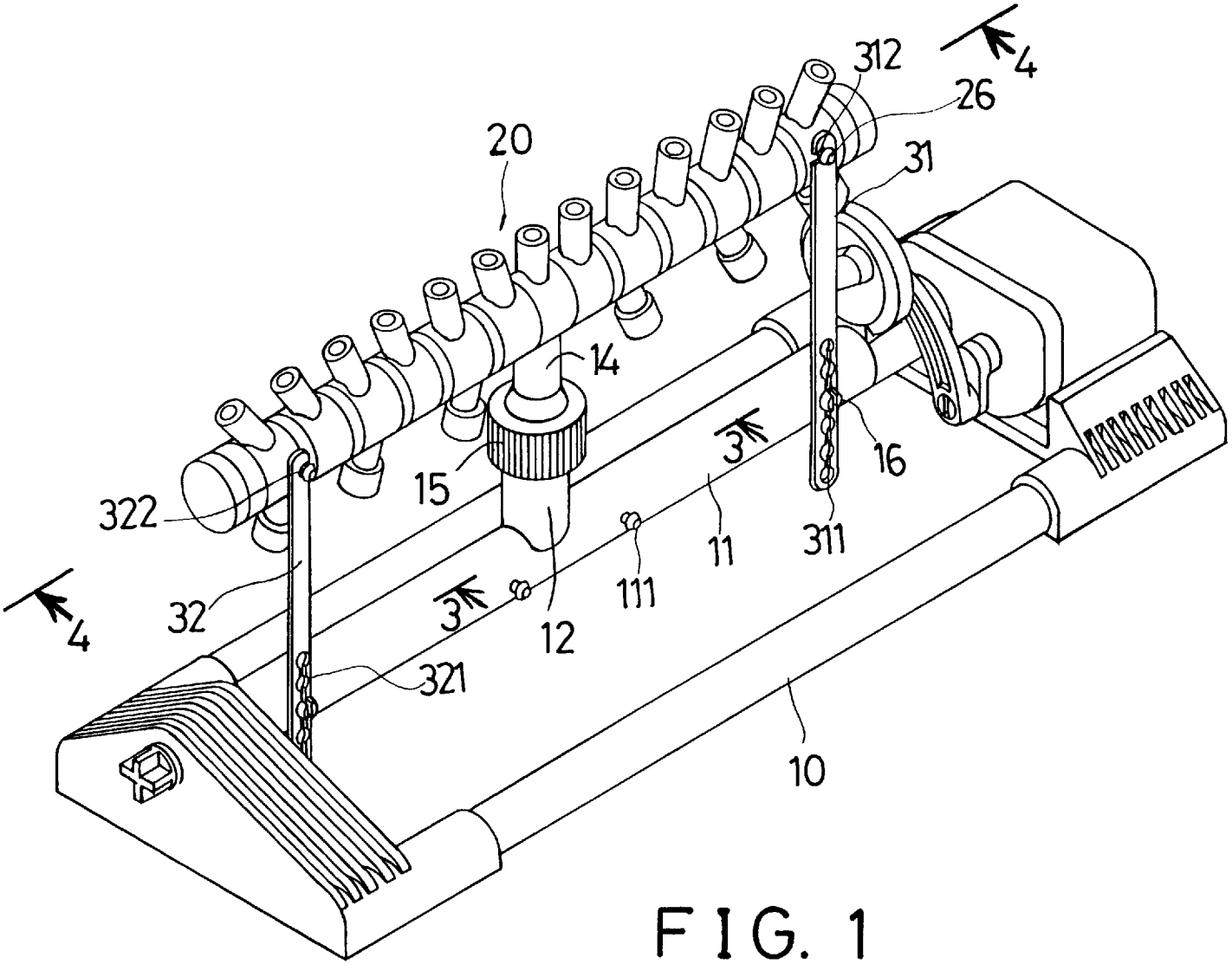
FIG. 1 is a perspective view of a sprinkler in accordance with the present invention.
Figure 2:
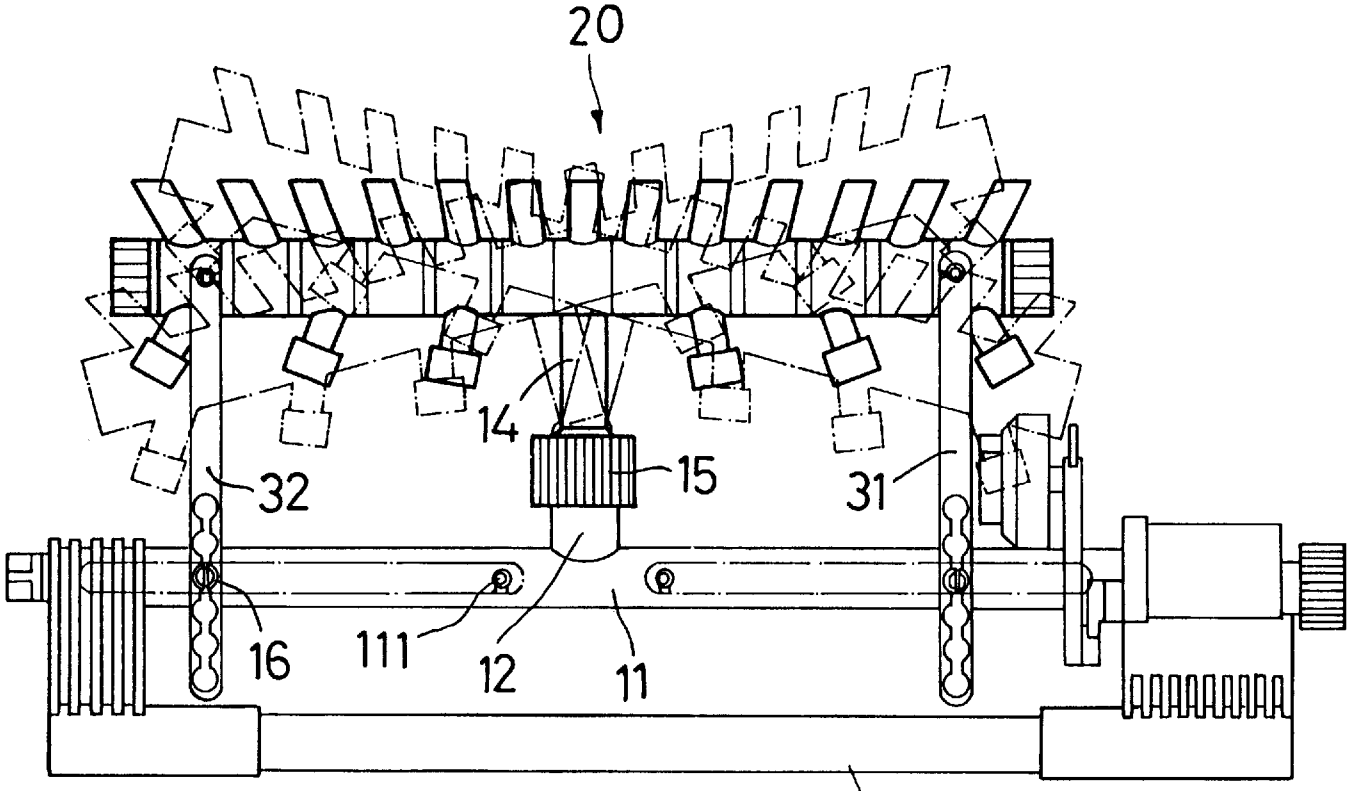
FIG. 2 is a plane view of the sprinkler.
Figure 3:
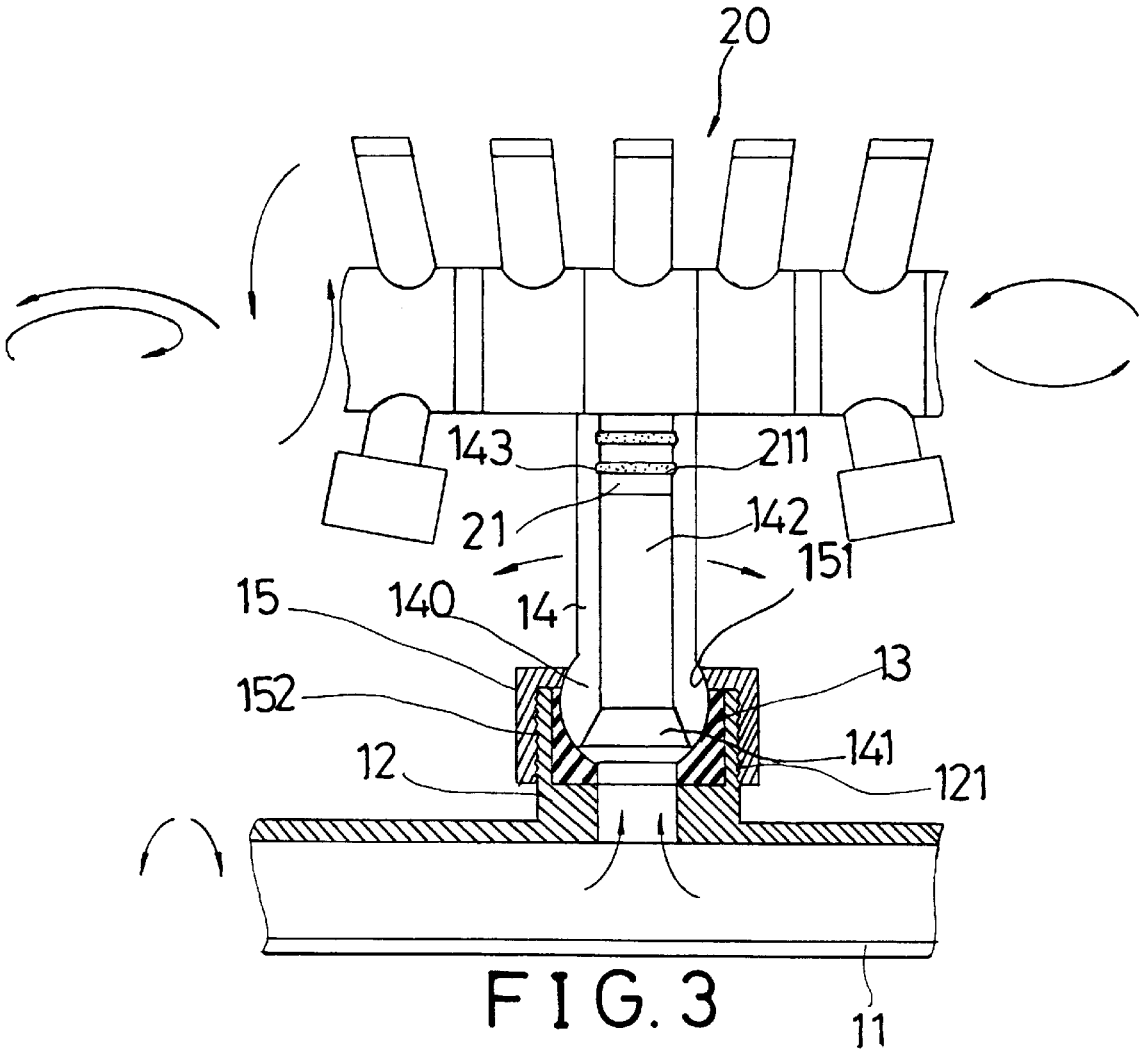
FIG. 3 is a partial cross sectional view taken along lines 3—3 of FIG. 1.

Referring to the drawings, and initially to FIGS. 1–3, a sprinkler in accordance with the present invention comprises a base 10 including a tube 11 rotatably secured in the base 10 and coupled to a water reservoir for receiving water. The rotational movement of the tube 11 is typical and will not be described in further details. The tube 11 includes two projections 16 and two stops 111, and includes a stud 12 having an outer thread 121 (FIG. 3). A gasket 13 is engaged in the stud 12. A conduit 14 has a ball 140 rotatably engaged in the stud 12 and engaged with the gasket 13. A cover 15 includes an inner thread 152 for engaging with the outer thread 121 of the stud 12 and includes an orifice 151 for engaging with the ball 140 and for rotatably securing the conduit 14 to the stud 12. The ball 140 includes a bore 142 and includes a frustum shaped inlet 141 for allowing water to smoothly flow into the conduit 14 from the tube 11 when the conduit 14 is rotated relative to the stud 12.

Figure 8:
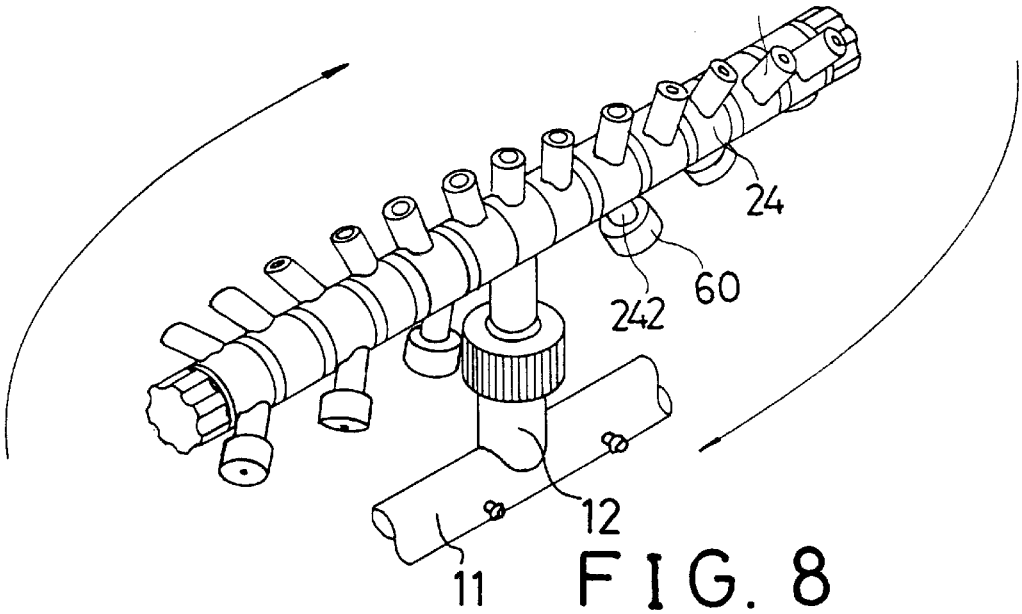
FIG. 8 is a partial perspective view of the sprinkler.
Figure 5:
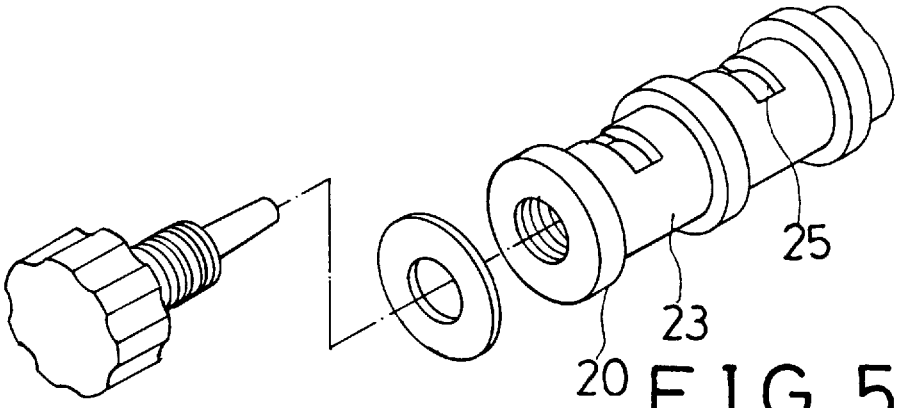
FIG. 5 is a partial exploded view of the pipe.
Figure 4:
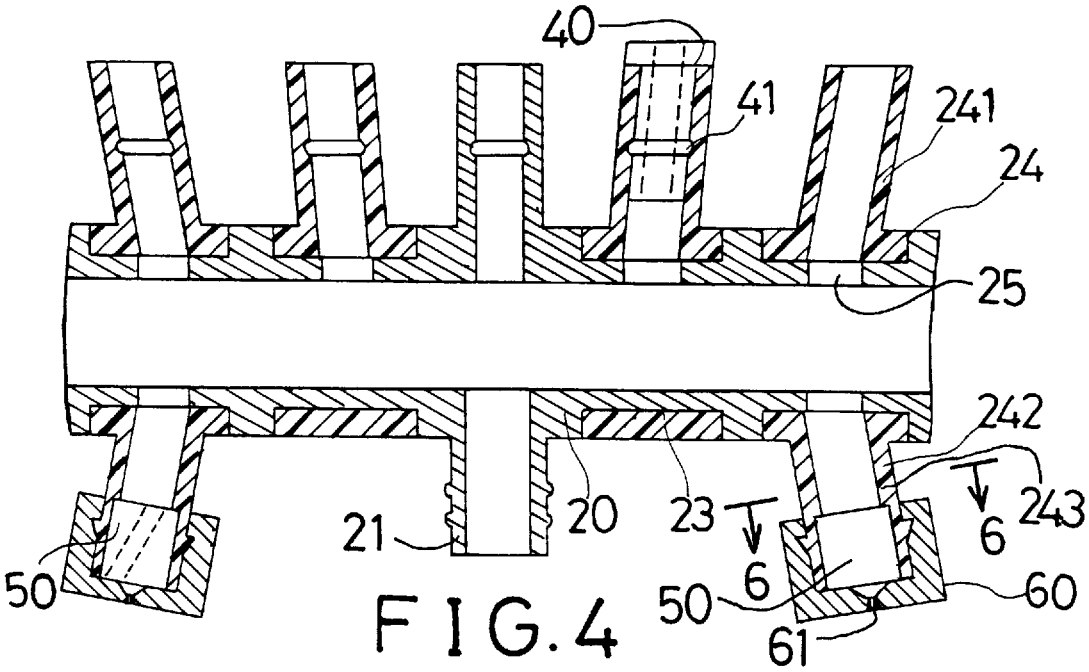
FIG. 4 is a partial cross sectional view taken along lines 4—4 of FIG. 1.
Figure 7:
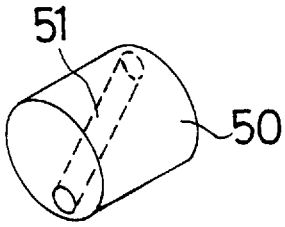
FIG. 7 is a perspective view of a guide.
Figure 6:
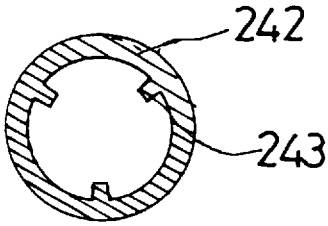
FIG. 6 is a cross sectional view taken along lines 6—6 of FIG. 4.

A pipe 20 includes an extension 21 rotatably engaged in the upper end of the conduit 14 and has one or more sealing rings 211 engaged with the annular grooves 143 of the conduit 14 for making a water tight seal between the extension 21 and the conduit 14 and for allowing the extension 21 and the pipe 20 to be rotatable about the conduit 14. As shown in FIGS. 4 and 5, the pipe 20 includes a number of annular recesses 23 and a number of ports 25 communicating with the annular recesses 23. A number of sleeves 24 of rubber material are engaged in the annular recesses 23 and each includes one or more outlets 241, 242 communicating with the ports 25. One or more nozzles 40 may be engaged in the outlets 241 for forming different outlet spraying conditions. A sealing ring 41 may be engaged between the nozzle 40 and the outlet 241 for securing the nozzle 40 to the outlet 241. The outlets 242 may each include one or more ribs 243 for engaging with another nozzle 50 (FIGS. 4, 6, 7) which includes an inclined passage 51. A number of caps 60 are secured to the outlets 242 for securing the nozzles 50 in the outlets 242 and each includes an opening 61 communicating with the passage 51 of the nozzle 50. The passage 51 has only a portion communicating with the opening 61 such that the water flowing through the opening 61 is tilted relative to the outlet 242 and such that the pipe 20 may be rotated about the conduit 14 when the sleeves 24 and the outlets 242 are rotated to different angles (FIG. 8).

Referring again to FIGS. 1 and 2, one or two bars 31, 32 each has a number of apertures 311, 321 engaged with the projections 16 and adjustable relative to the projections 16 for allowing the pipe 20 to be adjusted to different angular position relative to the tube 11 (FIG. 2). The bars 31, 32 each includes a hook 312, 322 for engaging with the pins 26 of the pipe 20 and for securing the pipe 20 to the tube 11 such that the tube 11 and the pipe 20 are rotatable in concert with each other about the tube 11.

Accordingly, the sprinkler in accordance with the present invention includes a pipe that may be secured to the tube and rotated in concert with the tube and that may be rotated relative to the tube. The sprinkler includes a greatly simplified configuration for allowing the sprinkler to adjust to different oscillation conditions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sprinkler comprising:

a base including a tube for receiving water, said tube including a stud, a pipe including an extension rotatably secured to said stud of said tube for receiving water from said tube and for allowing said pipe to be rotated about said stud, said pipe including a plurality of annular recesses and a plurality of ports communicating with said annular recesses, and a plurality of sleeves rotatably engaged in said annular recesses of said pipe, said sleeves each including at least one first outlet communicating with said port for allowing water to flow out of said first outlet via said port, said sleeves and said first outlets of said sleeves being adapted to be rotated relative to said pipe for allowing outlet water to force said pipe to rotate about said stud.

2. A sprinkler according to claim 1, wherein said sleeves each includes at least one second outlet, and a nozzle secured in said second outlet, said nozzle includes an inclined passage for allowing the outlet water to be inclined relative to said second outlet.

3. A sprinkler according to claim 2, wherein said second outlet each includes at least one rib for engaging with said nozzle and each includes a cap for securing said nozzle in said second outlet.

4. A sprinkler according to claim 1, wherein said pipe includes at least one nozzle engaged in said first outlet.

5. A sprinkler according to claim 1 further comprising a conduit including a first end having a ball rotatably engaged in said stud and including a second end, a gasket engaged between said ball and said stud, a cover secured to said stud for rotatably retaining said ball in said stud, said extension of said pipe being rotatably engaged in said second end of said conduit.

6. A sprinkler comprising:

a base, a tube rotatably secured in said base for receiving water, said tube including a stud and including at least one projection, a pipe including an extension rotatably secured to said stud of said tube for receiving water from said tube and for allowing said pipe to be rotated about said stud, said pipe including at least one pin, and at least one bar including a first end engaged with said at least one projection of said tube and including a second end for engaging with said at least one pin and for securing said pipe to said tube and for allowing said tube and said pipe to be rotated in concert with each other about said tube.

7. A sprinkler according to claim 6, wherein said at least one bar includes a plurality of apertures for engaging with said at least one projection and for allowing said pipe to be adjusted to different inclined angle relative to said tube.

8. A sprinkler according to claim 6, wherein said second end of said at least one bar includes a hook for engaging with said at least one pin and for allowing said hook to be disengaged from said at least one pin.

* * * * *